US007410566B2

(12) United States Patent
Vaarkamp et al.

(10) Patent No.: US 7,410,566 B2
(45) Date of Patent: Aug. 12, 2008

(54) HYDROPROCESSING OF HYDROCARBON FEEDSTOCK

(75) Inventors: Marius Vaarkamp, Houston, TX (US); Chung-Ming Chi, Weymouth, MA (US); Hubertus Adrianus Duijndam, Delft (NL)

(73) Assignee: BASF Catalysts LLC, Florham Park, NJ (US)

( * ) Notice: Subject to any disclaimer, the term of this patent is extended or adjusted under 35 U.S.C. 154(b) by 285 days.

(21) Appl. No.: 10/510,463

(22) PCT Filed: Apr. 7, 2003

(86) PCT No.: PCT/NL03/00260

§ 371 (c)(1),
(2), (4) Date: Jun. 20, 2005

(87) PCT Pub. No.: WO03/087272

PCT Pub. Date: Oct. 23, 2003

(65) Prior Publication Data

US 2005/0230287 A1 Oct. 20, 2005

(30) Foreign Application Priority Data

Apr. 5, 2002 (EP) ..... 02076335

(51) Int. Cl.
*C10G 45/04* (2006.01)
*C10G 65/04* (2006.01)

(52) U.S. Cl. ..... 208/210; 208/58; 208/59; 208/254 H

(58) Field of Classification Search ..... 208/210, 208/58, 59, 254 H
See application file for complete search history.

(56) References Cited

U.S. PATENT DOCUMENTS 6,261,441 B1 7/2001 Gentry et al.

FOREIGN PATENT DOCUMENTS

| | | |
|---|---|---|
| EP | 0575077 | 12/1993 |
| WO | WO 03/087272 | 10/2003 |

OTHER PUBLICATIONS

International Search Report, PCT/NL03/00260, Sep. 19, 2003.

*Primary Examiner*—Glenn Caldarola
*Assistant Examiner*—John C Douglas
(74) *Attorney, Agent, or Firm*—Raymond F. Keller; Amin, Turocy & Calvin, LLP

(57) ABSTRACT

The invention is directed to a process for hydroprocessing of hydrocarbon feedstock containing sulfur and/or nitrogen contaminants, said process comprising first contacting the hydrocarbon feedstock with hydrogen in the presence of at least one first group VIII metal on a first acidic support catalyst, and thereafter contacting the feedstock with hydrogen in the presence of at least one second group VIII metal catalyst on a less acidic support.

20 Claims, No Drawings

HYDROPROCESSING OF HYDROCARBON FEEDSTOCK

The invention is directed to the hydroprocessing of hydrocarbon feedstocks, more in particular of liquid petroleum streams in refineries.

In present days, the petroleum industry needs to rely more heavily on relatively high boiling feedstocks derived from such materials as coal, tar sands, oil-shale, and heavy crudes. Such feedstocks generally contain significantly more undesirable components, especially from an environmental point of view. Such undesirable components include halides, metals and heteroatoms such as sulfur, nitrogen, and oxygen. Furthermore, specifications for fuels, lubricants, and chemical products, with respect to such undesirable components, are continually becoming tighter. Consequently, such feedstocks and product streams require more severe upgrading in order to reduce the content of such undesirable components. More severe upgrading, of course, adds considerably to the expense of processing these petroleum streams.

Hydroprocessing, which includes hydroconversion, hydrocracking, hydrotreating, hydrogenation, hydrofinishing and hydroisomerization, plays an important role in upgrading petroleum streams to meet the more stringent quality requirements. For example, there is an increasing demand for improved hetero-atom removal, aromatic saturation, and boiling point reduction. Much work is presently being done in hydrotreating because of greater demands for the removal of heteroatoms, most notably sulfur, from transportation and heating fuel streams. Hydrotreating is well known in the art and usually involves treating the petroleum streams with hydrogen in the presence of a supported catalyst at hydrotreating conditions.

Much work is being done to develop more active catalysts and improved reaction vessel designs in order to meet the demand for more effective hydroprocessing processes.

Group VIII metals are known for their excellent hydrogenation activity. However, their use has been restricted due to their sensitivity to contaminants, especially in the above discussed heavier feedstocks. Important contaminants that influence the group VIII metal catalysts are nitrogen and sulfur.

Recently, Group VIII metal catalysts have become available that are based on strongly acidic supports, such as zeolites, or zeolites containing supports. These noble metal catalysts show an improved tolerance for sulfur and nitrogen. These catalysts can tolerate these contaminants to level of up to 1000 ppm or more, under hydroprocessing conditions. A disadvantage of these catalysts is that they show an increased tendency towards cracking, which results in a decreased product yield.

It is an object of the invention to provide a process of the above kind with an improved tolerance for contaminants, such as sulfur and nitrogen. It is a further object to provide a process having an advantageous balance between yield and tolerance for contaminants, in particular a good balance between life-time, activity and productivity.

The invention is based on the surprising fact, that these objects can be attained by the combination of at least two catalyst beds, wherein the first one has a better tolerance for organo-sulfur and organo-nitrogen compounds, whereas the second bed has a better behavior with respect to cracking. It has been found that in case of a combination of these two beds, an optimal combination is obtained, resulting therein that highly contaminated feedstocks can be processed, without the high level of cracking that is connected with the use of highly acidic supports.

The invention accordingly is directed to a process for hydroprocessing of hydrocarbon feedstock containing sulfur and/or nitrogen contaminants, said process comprising first contacting the hydrocarbon feedstock with hydrogen in the presence of at least one first group VIII metal on an acidic support catalyst, and thereafter contacting the feedstock with hydrogen in the presence of at least one second group VIII metal catalyst on a less acidic support.

Hydroprocessing in the meaning of the present invention comprises hydroconversion, hydrocracking, hydrotreating, hydrogenating, hydrofinishing and hydroisomerization of petroleum feedstocks, such as solvents and middle distillate.

A process according to the invention has been found to be very suitable to reduce the content of aromatic compounds in a feedstock with a high degree of selectivity. More in particular, it has been found possible to achieve this, whilst substantially avoiding or at least reducing the formation of gaseous hydrocarbons, such as the formation of gaseous hydrocarbons by hydrocracking in the first catalyst. It has further been found that the present invention allows the processing of a feedstock into a product of which the boiling point is changed (typically decreased) to a relatively low extent in comparison to known processes.

In the present invention the feedstock to be hydroprocessed is first contacted with hydrogen in one or more catalysts beds. The catalyst in these one or more catalyst beds is a Group VIII metal on a strongly acidic support (as defined hereafter). In case several of this first type of catalyst beds on a strongly acidic support are used, the supports in these beds may have the same or a different acidity. If the acidities in any of these beds of catalysts on a strongly acidic support differ, it is preferred that the acidity is strongest in the first catalyst bed and decreases with every subsequent catalyst bed. Group VIII metals to be used in the context of the present invention comprise Pt, Pd, Ir, Rh, Ru and combinations (alloys) thereof such as the preferred PtPd alloy. The strongly acidic support to be used in the first catalyst is preferably selected from zeolites and zeolite containing supports. Examples of suitable zeolites are large pore molecular sieves like zeolite Y, ultrastable zeolite Y, zeolite beta, mordenite, MCM type materials or molecular sieves with a crystal size smaller than 2 micron. Also it is possible to use zeolite containing supports such as combinations of zeolite and metal/metalloid oxides. The amount of Group VIII metal is between 0.001 and 2.5 wt. %, calculated on the combined weight of catalyst and support.

The effluent from the last of said catalyst beds with a catalyst on an acidic support is, optionally after stripping, fed to one or more second catalyst beds, also containing a Group VIII metal catalyst, but now on a less acidic support. In case several second catalyst beds (i.e. beds containing a catalyst on a less acidic support) are used, the supports in these beds may have the same or a different acidity. If the acidities in any of the second beds differ, it is preferred that the acidity is relatively the strongest in the first catalyst bed and decreases with every subsequent catalyst bed. The Group VIII metals are selected from the same group as given above. However, it is not necessary to use identical Group VIII metals in the second catalyst as in the first catalyst. The amount of Group VIII metal in the second catalyst may be in the same range as in the first catalyst. However, the amount need not be the same. The support to be used in the second catalyst is less acidic than the support in the first catalyst. Suitable support materials are silica, alumina, silica-alumina, titania, zirconia, low acidity zeolites and mixtures thereof The ratio of the volumes (and of the, residence times of the feedstock in the presence of the catalysts) of the first catalyst (beds) and the second catalyst (beds) may vary between wide ranges, depending on the nature of the feedstock and the required type and amount of hydroprocessing. Generally it will be preferred that the volume of the first catalyst is at most equal to the volume of the second catalyst. Suitable volumetric ratios are from 1 to 10 and 10 to 1, preferably 1 to 3 and 3 to 1, most preferably 1 to 1

As has been indicated previously, the acidity of the supports has to be different. Generally the acidity is determined as Brønsted acidity. According to a preferred embodiment the upstream catalyst has a Brønsted acidity of at least 5 μmol/g, as defined in the experimental part. More in particular the lower limit is preferably 25 μmol/g, more preferably 50 μmol/g. The acidity of the support of the downstream catalyst is preferably at most 10 μmol/g, more preferably less than 4 μmol/g (both determined as indicated in the experimental part).

The present invention resides therein, that an optimal balance of product yield and catalyst can be obtained in hydroprocessing, when the process is split over two different catalysts, the difference being in the first place in the nature of the support. More in particular the process of the invention is less sensitive to the contaminants in the feed, than when only the downstream catalyst is used, resulting in an increased life time of the catalyst, without detriment to the yield. More in particular the amount of coking is reduced. Another advantage is that the total catalyst volume is lower and hence less precious metal is needed. Both are economic advantages.

It is assumed that over the first catalyst the majority of the organo-sulfur and organo-nitrogen compounds are converted to low molecular weight sulfur and nitrogen compounds on the one hand and hydrocarbons on the other hand. As the contact time with this first catalyst is low compared to the total hydroprocessing time, the amount of cracking turns out to be especially low. The cited low cracking is an advantage of the process when compared to a process that exclusively uses the high acidity catalyst.

The process conditions for the hydroprocessing can be selected in dependence of the nature of the feed and the properties required of the product stream. The process conditions are the known ones used for the hydrogenation, hydroisomerization, hydrocracking and/or hydrodesulfurization of the feeds used.

The hydrogen (partial) pressure used for the hydrogenation, hydroisomerization, hydrocracking and/or hydrodesulfurization depends on the type of feed and is preferably of from 0.5 to 300 bara, more preferably of from 0.9 to 250 bara.

Generally suitable conditions for the process according to the invention further comprise temperatures between 50 and 450° C. and liquid hourly space velocities (LHSV) between 0.1 and 25 $h^{-1}$.

Depending on the type of feedstock and the hydrogen partial pressure, the temperature can suitably be chosen within the said range. More in particular it is to be noted that hydrocracking requires the highest temperature range, i.e. up to 450° C., whereas for hydrodesulfurization temperatures up to 400° C. suffice.

Hydrogenation and hydroisomerization can be performed using temperatures of up to 350° C.

When a higher temperature is chosen, a higher pressure is needed to prevent excessive coke formation on the catalyst. This means that the process will not work under catalytic reforming conditions.

The process configuration will mainly depend on the local situation and the actual type of process. It is possible to use one reactor or a number of reactors. It is also possible to use one or more catalyst beds for each catalyst, either in one reactor or in more reactors. It is also possible to include both catalyst beds in one reactor, on top of each other, or separated from each other by suitable devices.

In general the effluent from the first catalyst is directly contacted with the second catalyst. However, it is also possible to include another unit operation in between, for example a stripping stage to remove converted nitrogen and sulfur contaminants, that have been converted over the first catalyst to volatile components.

The feedstocks to be treated in the process of the present invention are generally petroleum base feedstocks, such as solvents, middle distillates, diesel, light cycle oil, lube oil, white oil, products from a GTL plant all of these are preferably hydrotreated prior to use as a feedstock for the process. Mixtures of these feedstocks can be used as well.

Typical feedstocks to be hydrogenated, hydro-isomerized, hydrocracked and/or hydride-sulfurized in the process of the invention usually have a sulfur contaminant content of from 0.1 to 500 ppm, preferably from 0.1 to 300 ppm calculated as sulfur, based on the weight of the feedstock. Examples of such feeds are inter alia benzene, "white oils", gasoline, middle distillates, such as diesel and kerosene, solvents and resins. More in particular the process is to be used for hydrogenating aromatic compounds in these feedstocks, e.g. dearomatizing hydrocarbon feeds that may contain thiophenic sulfur contaminants and/or nitrogen containing contaminants.

Surprisingly, it has further been found that olefins in an aromatic feedstock may be selectively hydrogenated in a process according to the invention. Particularly when a catalyst comprising only palladium is used, this hydrogenation of olefins in an aromatic feedstock is highly efficient.

The invention is now elucidated on the basis of some examples, which are not intended to limit the scope of the invention.

EXAMPLES

Acidity of Catalysts

Pyridine adsorption experiments were done in a diffuse reflectance high temperature chamber equipped with KBr windows(Spectra-Tech). The chamber was connected with a gas system so that gases can flow through the chamber and the chamber can be evacuated.

Samples were ground into a fine powder and put into an aluminum sample cup. The samples were first heated to 450° C. and held at 450° C. for at least 1 h while a flow of inert gas was led through the chamber. After cooling to ambient temperature, a pyridine inert gas mixture was led through the chamber for about 1 min. Subsequently, the pyridine flow was stopped, while the flow of inert gas continued and the system was kept in this mode for at least 1 h. Finally, the sample was heated to 180° C. in the flow of inert gas and held at 180° C. for at least 1 h, then cooled to room temperature. The amount of adsorbed pyridine on Brønsted and Lewis acid sites, was determined using the difference in the infrared spectra after the outgassing at 450° C. and desorbing the pyridine at 180° C., by making use of the corresponding pyrimidiniun band and pyridine Lewis acid band with known extinction coefficients.

Dispersion

The dispersion degree can be determined by measuring the amount of CO adsorbed on a sample in reduced form of the catalyst at 25° C. and a pressure of 1 bar as follows A known amount of a sample of the catalyst is placed in a reactor and reduced with hydrogen at 200° C. After cooling in hydrogen to 25° C., the reactor is flushed with helium for at least 30 minutes.. Subsequently, the helium stream is interchanged with six pulses of a known amousit of CO and the concentration of CO is measured at the outlet of the reactor with a thermal conductivity detector The amounts of catalyst and CO are chosen such that the catalyst is saturated with CO after the first pulse, the second through sixth pulse are used to verify this.

The upper Unit for the dispersion degree corresponds to the theoretical number of CO atoms that can be bound to one noble metal (Pt, Ir, Ru, Rh or Pd) atom. For practical purposes a value of 1 is generally a suitable upper limit.

The invention claimed is:

1. Process for hydroprocessing of hydrocarbon feedstock containing sulfur and/or nitrogen contaminants, said process comprising first contacting the hydrocarbon feedstock with hydrogen in the presence of at least one first group VIII metal on a first acidic support catalyst, and thereafter contacting the feedstock with hydrogen in the presence of at least one second group VIII metal catalyst on a less acidic support, wherein the said less acidic support has an acidity, as defined herein, of at most 10 μmol/g, with the proviso that the acidity is lower than the acidity of the support of the at least one first catalyst.

2. Process according to claim 1, wherein the said hydroprocessing comprises hydroconversion, hydrocracking, hydrotreating, hydrogenating, hydrofinishing and hydroisomerization of petroleum feedstocks, such as solvents and middle distillate.

3. Process according to claim 1, wherein the support of the at least one first group VIII metal catalyst is selected from the group of zeolites and zeolite containing supports.

4. Process according to claim 1, wherein the support of the at least one second group VIII metal catalyst is selected from the group of silica-alumina and other non-zeolite supports.

5. Process according to claim 1, wherein the said strongly acidic support has an acidity, as defined herein, of at least 5 μmol/g.

6. Process according to claim 1, wherein the organic sulfur level in the feed to the second catalyst bed is less than 50 ppm.

7. Process according to claim 1, wherein the Group VIII metal of both the first and second catalyst have been selected, independently of each other, from the group of Pt, Pd, Ir, Rh, Ru and combinations of two or more of these elements.

8. Process according to claim 1, wherein the amounts of Group VIII metal, calculated on the combined weight of the metal and the support in the first and in the second catalyst, are independently of each other between 0.001 and 2.5 wt. %.

9. Process according to claim 1, wherein the volume of the at least one first catalyst is between 10 and 50% of the total volume of the first and second catalysts.

10. Process according to claim 1, wherein the temperature at the inlet of the first catalyst is between 100 and 400°C.

11. Process according to claim 1, wherein the hydrogen pressure is between 0.5 and 300 bar.

12. Process according to claim 1, wherein the organic sulfur level in the feed to the second catalyst bed is less than 500 ppm.

13. Process according to claim 12, wherein the organic nitrogen level in the feed to the second catalyst is less than 100 ppm.

14. Process according to claim 1, wherein the said first and second catalysts beds are present in one reactor, or in different reactors.

15. Process according to claim 1, wherein the effluent from the last of said at least one first catalysts is passed through a stripper prior to contacting it with the said second catalyst on a less acidic support.

16. Process for hydroprocessing of hydrocarbon feedstock containing sulfur and/or nitrogen contaminants, said process comprising first contacting the hydrocarbon feedstock with hydrogen in the presence of at least one first group VIII metal on a first acidic support catalyst, and thereafter contacting the feedstock with hydrogen in the presence of at least one second group VIII metal catalyst on a less acidic support, wherein the said strongly acidic support has an acidity, as defined herein, of at least 5 μmol/g.

17. Process according to claim 16, wherein the organic sulfur level in the feed to the second catalyst bed is less than 500 ppm.

18. Process according to claim 16, wherein the said hydroprocessing comprises hydroconversion, hydrocracking, hydrotreating, hydrogenating, hydrofinishing and hydroisomerization of petroleum feedstocks, such as solvents and middle distillate.

19. Process according to claim 16, wherein the support of the at least one first group VIII metal catalyst is selected from the group of zeolites and zeolite containing supports.

20. Process according to claim 16, wherein the volume of the at least one first catalyst is between 10 and 50% of the total volume of the first and second catalysts.

* * * * *